United States Patent [19]

Sassmannshausen

[11] 4,143,412

[45] Mar. 6, 1979

[54] LIGHTING FIXTURE, FOR A TAIL, WARNING OR SIGNAL LIGHT

[76] Inventor: Knut O. Sassmannshausen, 5, Pinewood Estate, Wexford, Ireland

[21] Appl. No.: 808,728

[22] Filed: Jun. 21, 1977

[30] Foreign Application Priority Data

Jun. 24, 1976 [DE] Fed. Rep. of Germany ..... 2628243
Oct. 22, 1976 [DE] Fed. Rep. of Germany ..... 2647889

[51] Int. Cl.[2] ..... F21V 7/00

[52] U.S. Cl. ..... 362/297; 362/346; 362/348

[58] Field of Search ..... 362/291, 292, 297, 327, 362/328, 336, 343, 346, 348

[56] References Cited

U.S. PATENT DOCUMENTS

| | | | |
|---|---|---|---|
| 1,260,387 | 3/1918 | Johanson | 362/348 |
| 1,618,010 | 2/1927 | Hoss | 362/292 |
| 2,086,388 | 7/1937 | Nechin | 362/327 X |
| 2,556,328 | 6/1951 | Hinds | 362/336 X |
| 2,830,175 | 4/1958 | Jahnsen | 362/291 |
| 3,700,883 | 10/1972 | Donohue et al. | 362/297 |
| 4,028,542 | 6/1977 | McReynolds, Jr. | 362/297 |

*Primary Examiner*—Peter A. Nelson
*Attorney, Agent, or Firm*—Herbert L. Lerner

[57] ABSTRACT

Lighting fixture includes a concave reflector having a given focal region and an axis, and means at least partly disposed in the focal region for supplying a source of light thereat reflectible at maximal intensity by the concave reflector in direction of the axis thereof and reflectible at decreasing intensity in direction extending from the light source at an increasing angle $\beta$ relative to the direction of the axis, so that (a) at $\beta = 1°$, the light intensity is at least 200%,
(b) at $\beta = 2.5°$, the light intensity is at least 150%, and
(c) at $\beta = 5°$, the light intensity is at least 120% of the light intensity at $\beta = 10°$.

31 Claims, 10 Drawing Figures

LIGHTING FIXTURE, FOR A TAIL, WARNING OR SIGNAL LIGHT

The invention relates to a lighting fixture, such as a tail, warning or signal light especially for vehicles, (for example, motor vehicles or bicycles), the lighting fixture having a luminous body which fills at least part of the focal space of a usually parabolic reflector.

The main light beam reflected by the concave reflector of such a lighting fixture is conical. According to regulations in Germany, for example, such a reflected main light beam should illuminate at least an angular range of square cross section which extends 10° upwardly, 10° downwardly, 10° to the right-hand side and 10° to the left-hand side of the direction of travel. In order to attain such an aperture angle of 20° in the vertical and in the horizontal directions, respectively, the aperture angle of an axially symmetrical main light beam with respect to the travel direction must be at least about 28°. In heretofore known lighting fixtures, the light intensity (as measured in candelas or new candles) is as uniform as possible in this main light beam. However, if the energy available for the operation of the lighting fixture is limited as, for example, in bicycles or in battery-supplied parking lights of motor vehicles, then it is more advantageous to distribute the light intensities within the main light beam nonuniformly, in accordance with physical law.

This is best explained by an example. A cyclist rides in a straight two-lane road 8 m wide at a spacing of 1 m from the right-hand shoulder or edge of the road. The difference in velocity between the bicyclist and a passenger car following him is generally very great, especially on straightaways, if the cyclist rides at 15 km/h, for example, and the motor vehicle travels at 100 km/h. Because of this great difference in velocity, the cyclist is overtaken by the motor vehicle following him faster than if he were in a motor vehicle himself, so that the tail light of the bicycle should be visible better and farther than that of a motor vehicle. However, since the cyclist has less energy available to him than to a motor vehicle, the tail light of the bicycle is weaker, according to the present state of the art, than that of a motor vehicle.

On a straight road, an extremely high light intensity of the tail light exactly opposite the direction of travel i.e. in the direction of the axis of the concave reflector would be sufficient if the driver of the motor vehicle were also located at a distance of 1 m from the shoulder of the road as he is driving. However, a driver of a motor vehicle usually drives in such a manner that he himself is seated about in the center of the roadway. The distance of the motor vehicle driver from the shoulder of the road is then 4 m in the case of the assumed two-lane road which is 8 m wide. The line along which the driver of the motor vehicle moves is thus offset 3 m relative to the line along which the tail light of the bicycle moves. Under these geometrical conditions, the tail light of the bicycle should be visible to the driver of the motor vehicle (a) for a distance of 170 m at an angle of 20°, (b) for a distance of 70 m at an angle of 5° and (c) for a distance of 17 m at an angle of 10° with respect to the line on which the driver moves. Starting from these considerations, it is an object of the invention to provide a lighting fixture, the visibility of which is substantially uniform for all reasonably expected distances (for example, from 170 m to 17 m). In heretofore known lighting fixtures, however, the visibility decreases considerably with distance because the light intensities in the solid angle that is of interest are substantially equal.

The visibility of a bicycle tail light depends, of course, also on other factors such as, for example, the width and curvature of the road, different driving characteristics, possible oncoming traffic and the like. But also after taking these factors into consideration, it remains advantageous to provide a lighting fixture which, in addition to having a minimum valve of brightness below which the value does not fall anywhere in the main light beam, has additionally, a brightness which increases towards the axis thereof.

In order to increase sharply the light intensity in the viewing directions which are required especially at great distances, only relatively small amounts of light are required (only little energy) because the closer the viewing direction is to the axis, the smaller is the solid angle to be illuminated and the smaller is, therefore, the amount of light required for increasing the light intensity.

It is accordingly an object of the invention to improve, with simple means and low energy consumption, the visibility of a lighting fixture, on the one hand, at great distances, and on the other hand, when approaching the light.

With the foregoing and other objects in view, there is provided in accordance with the invention, a lighting fixture comprising a concave reflector having a given focal region and an axis, and means at least partly disposed in the focal region for supplying a source of light thereat reflectible at maximal intensity by the concave reflector in direction of the axis thereof and reflectible at decreasing intensity in directions extending from the light source at an increasing angle $\beta$ relative to the direction of the axis, so that (a) at $\beta = 1°$, the light intensity is at least 200% and advantageously at least 300% and preferably at least 400%;

(b) at $\beta = 2.5°$, the light intensity is at least 150% and advantageously at least 200% and preferably 250%; and (c) at $\beta = 5°$, the light intensity is at least 120% and advantageously at least 140% and preferably at least 150% of the light intensity at $\beta = 10°$.

The three mentioned numerical values at 1°, 2.5° and 5° are points of a light-intensity distribution curve such as is shown, for example, in FIG. 2.

To an automobile driver who drives in the same direction as a cyclist but laterally offset by up to several meters, a lighting fixture according to the invention would, in the ideal case, be visible equally well from all reasonably considered distances which are within the illuminated aperture angle. For practical purposes, it is sufficient if the lighting fixture has a given minimum visibility at larger viewing angles with a corresponding minimum brightness value and if the brightness increases toward the axis so that the visibility decreases only slightly for greater distances (smaller viewing angles). Whereas, heretofore, uniform light intensity in the main light beam was sought after, according to the invention of this application, an approximately uniform visibility should be attained.

The angle-dependent distribution of the light intensity is realized, in accordance with other features of the invention in a lighting fixture, wherein the means for supplying a source of light comprise a luminous body disposed at least partially in the focal region of a concave reflector, the latter having a reflecting surface formed with a multiplicity of reflecting curved surface positions, (either convexities or concavities or both) the average or mean height of all the reflecting curved surface portions being equal to from 3% to 12% and advantageously 3.5% to 8% and preferably 4% to 5% of the average or mean smallest base diameter of all of the reflecting curved surface portions, the luminous body having a maximum spacing between two points thereof that is equal to at least 200% and advantageously at least 300% and preferably at least 500% of the average of mean height of all if the reflecting curved surface portions. Through the interaction of a luminous body of defined dimensions with the reflecting curved surface portion, the dimensions of which are related in the given manner to each other and to the dimension of the luminous body, a conical light beam is produced, the brightness of which increases to the observer continuously from the edge of the conical light beam toward the axis thereof in such a manner that the visibility of that beam is independent of the distance.

If calculations are made with the mean values of the heights and of the minimum or smallest base diameters of all reflecting curved surface portions, the possibility of individual, large deviations from these mean values are included. However, a correspondingly better light distribution is obtained, the smaller the deviations from the mean values. The best results are obtained, in accordance with another feature of the invention, when the height of substantially every individual reflecting curved surface portion is 3% to 12% and advantageously, 3.5% to 8% and preferably 4% to 5% of the smallest base diameter thereof, and the maximum distance or spacing between the two points of the luminous body is at least 200% and advantageously at least 300% and preferably at least 500% of the height of substantially every individual reflecting curved surface portion.

In accordance with yet another feature of the invention, the maximum dimension of a projection of the luminous body on a plane perpendicular to the direction of the maximum spacing between the two points thereof is equal to at least 25% of the mean height of all of the reflecting curved surface portions, and advantageously, of the height of substantially every individual reflecting curved surface portion.

A light distribution which is particularly advantageous for the observer in all viewing directions (lying in the illuminated aperture angle) is obtained when, in accordance with another feature of the invention, the concave reflector is a parabolic reflector and the mean minimum base diameter of all reflecting curved surface portions and, advantageously, the minimum base diameter of each individual reflecting curved surface portion is at most 40% and advantageously at most 30% and preferably at most 20% of the distance or spacing of the vertex or apex of the parabolic reflector from the focal point or the middle of the focal region of the parabolic reflector.

Good results are obtained in accordance with a further feature of the invention, wherein the surfaces of the reflecting curved surface portions form spherical calottes having a radius of curvature equal at most to 80% and advantageously at most to 60% and preferably at most to 30% of the distance or spacing of the apex or vertex of the parabolic reflector from the middle of the focal region of the parabolic reflector.

Disregarding the reflecting curved surface portions, the concave reflector is, in principle, parabolic, and it is therefore referred to herein as parabolic reflector, for short.

For controlling the light distribution, in accordance with added features of the invention, the reflecting curved surface portions are segments of ellipsoids or ellipsoidal surfaces and the base of the reflecting curved surface portions have an elongated plan view, which is substantially elliptical.

In accordance with yet a further feature of the invention, the concave reflector has a reflective surface formed with a multiplicity of reflecting curved surface portions in the shape of reflecting rings concentrically surrounding the axis of the concave reflector, the mean height of all of the rings being equal to from 3% to 12% and advantageously 3.5% to 8% and preferably 4% to 5% of the mean width of all of the rings, the means for supplying a source of light comprising a luminous body having a maximum spacing between two points thereof that is equal to at least 200% and advantageously at least 300% and generally at least 500% of the mean height of all of the rings.

In accordance with an added feature of the invention, the rings are formed of sections of reflecting toroidal surfaces.

To increase the light intensity especially in the direction of the axis, there is also provided in accordance with the invention, a lighting fixture wherein the concave reflector is a parabolic reflector, the reflecting rings being formed on the original parabolic surface thereof, and including surface regions substantially parallel to the original parabolic surface and interrupting the reflecting rings for intensifying the light intensity in direction of the axis of the reflector. When the curved surface portions are in the form of peenings or convexities and concavities, the surface regions that are parallel to the original parabolic surface can be carried by the peenings.

In order to make a lighting fixture which has a light distribution curve which is to be visible to observers especially at great distances, and in accordance with further features of the invention, noting that the concave reflector has an imaginary concave surface whereon the reflecting curved surface portions are formed, the sum of the base areas of the reflecting curved surface portions is equal to from 40% to 95% and advantageously 50% to 90% and preferably 60% to 80% of the imaginary or theoretical concave surface of the concave reflector. By the terms imaginary or theoretical areas there is means that areas with which the concave reflector would reflect if it had no reflecting curved surface portions. Thus, 60% to 5% and advantageously 50% to 10% and preferably 40% to 20% of the original paraboloid surface remains as "undisturbed paraboloid surface", the remainder being occupied by reflecting curved surface portions.

Because the exact dimensions of the individual parts and the precise spatial interrelationships thereof in the lighting fixture and lighting fixture assembly of the invention are very important, small tolerances should be maintained. For this purpose, it is advantageous, and in accordance with a concomitant feature of the invention, to construct the lighting fixture as a so-called sealed-beam unit.

Other features which are considered as characteristic for the invention are set forth in the appended claims.

Although the invention is illustrated and described herein as embodied in a lighting fixture, particularly a tail, warning or signal light, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
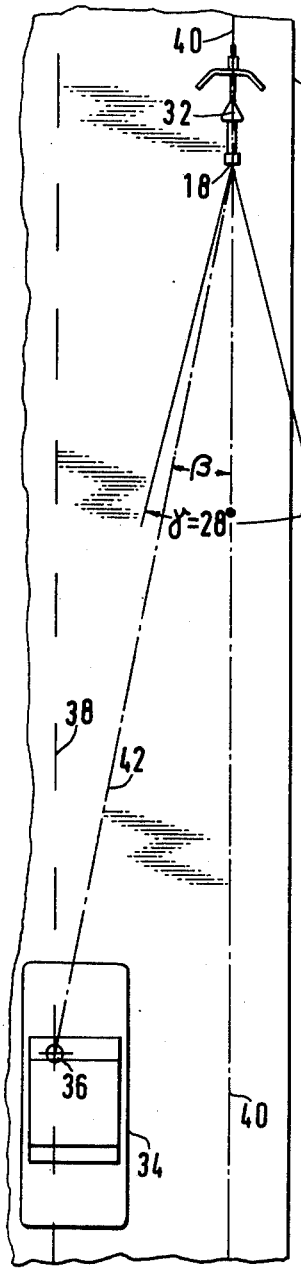
FIG. 1 is a diagrammatic plan view of a traffic situation wherein a motor vehicle is approaching a bicycle.

Referring now to the drawing and first, particularly, to FIG. 1 thereof, there is shown, close to the right-hand shoulder 30 of the road, a cyclist 32 with a tail light 18 which radiates light with an aperture angle $\gamma$ of 28°. The cyclist 32 is approached from the rear by a motor vehicle 34, the driver 36 of which moves along the center strip of the roadway 38. The distances of the motor vehicle 34 from the cyclist 32 are measured on the center strip 38 i.e. generally on the line of travel of the driver 36 of the motor vehicle 34. The viewing angle $\beta$ is the angle between the line of travel 40 of the cyclist 32 and the viewing direction 42 of the driver 36 onto the tail light 18.

Figure 2:
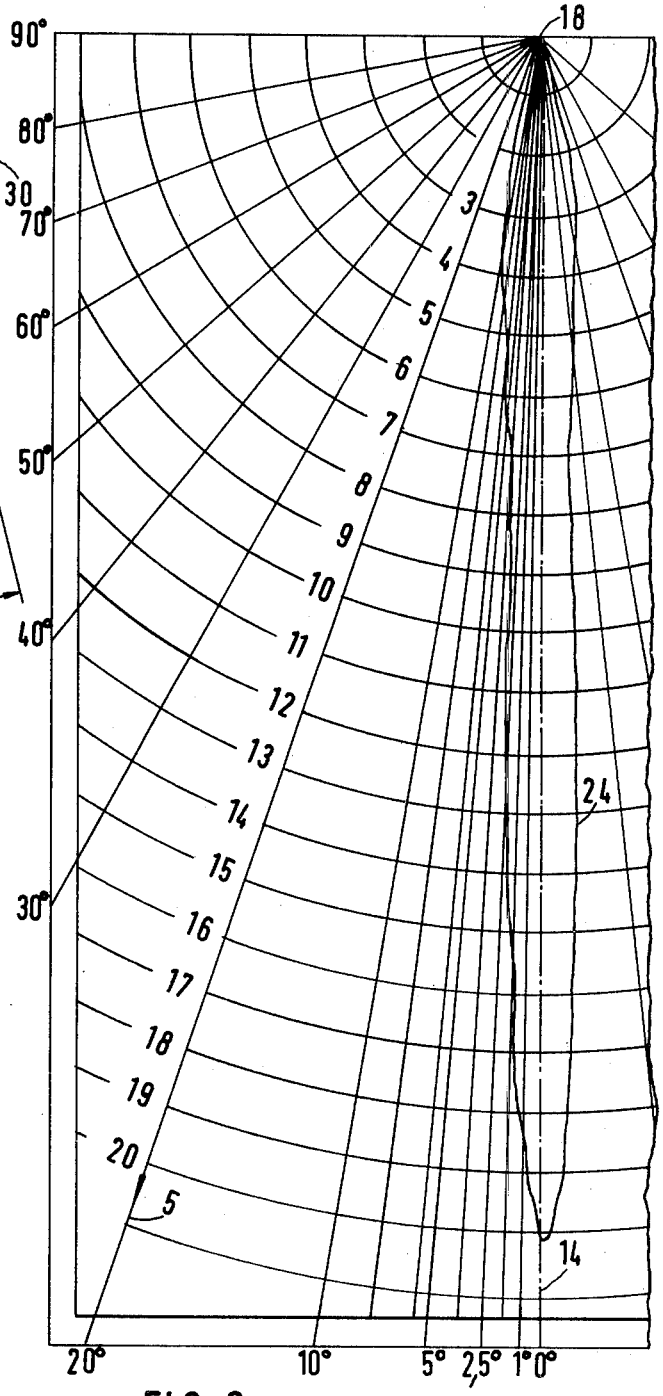
FIG. 2 is a plot diagram showing distribution of light intensity over viewing directions, in accordance with the invention.

In order that this tail light 18 be visible to the driver 36 from all reasonably considered distances, it has the light distribution curve shown in FIG. 2, in accordance with the invention:

The lighting fixture 18 according to the invention radiates or directs its beam substantially in the direction of the reflector axis 14. The angles $\beta$ of the viewing directions to the lighting fixture 18 are measured from the reflector axis 14 (viewing direction 0°) and given in degrees at the margin of the graph of FIG. 2. Around the lighting fixture 18 in FIG. 2 concentric circles are drawn having a distance therebetween corresponding to 1 candela (Note: The values of the light intensity in candelas at each of the distances from the lighting fixture 18 represented by the concentric circles are indicated on the line (5). The curve 24 indicates the dependence upon the viewing angle $\beta$ of the light intensity in candelas, measured on a lighting fixture 18 according to the invention. It is apparent that the light intensity, for a viewing direction of $\beta = 14°$, is about 2 candelas,
$\beta = 10°$, is about 4 candelas,
$\beta = 5°$, is about 6 candelas,
$\beta = 2.5°$, is about 13 candelas, and in the reflector axis 14, where $\beta = 0°$, is actually about 20 candelas.

The increase of the light intensity from outer viewing directions to the viewing direction exactly on the reflector axis 14 is enormous and effects a substantially uniform visibility of the lighting fixture 18 at different distances from the lighting fixture 18 that are to be considered in this connection.

Figure 3:
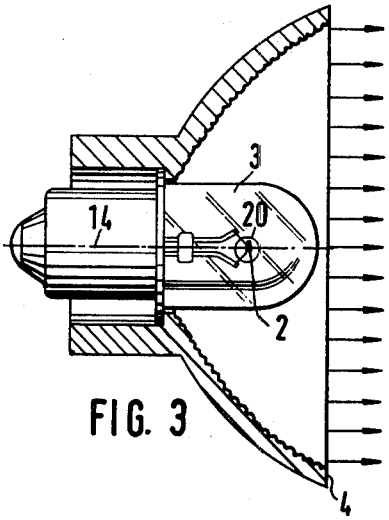
FIG. 3 is a longitudinal sectional view of a lighting fixture according to the invention.
Figure 5:
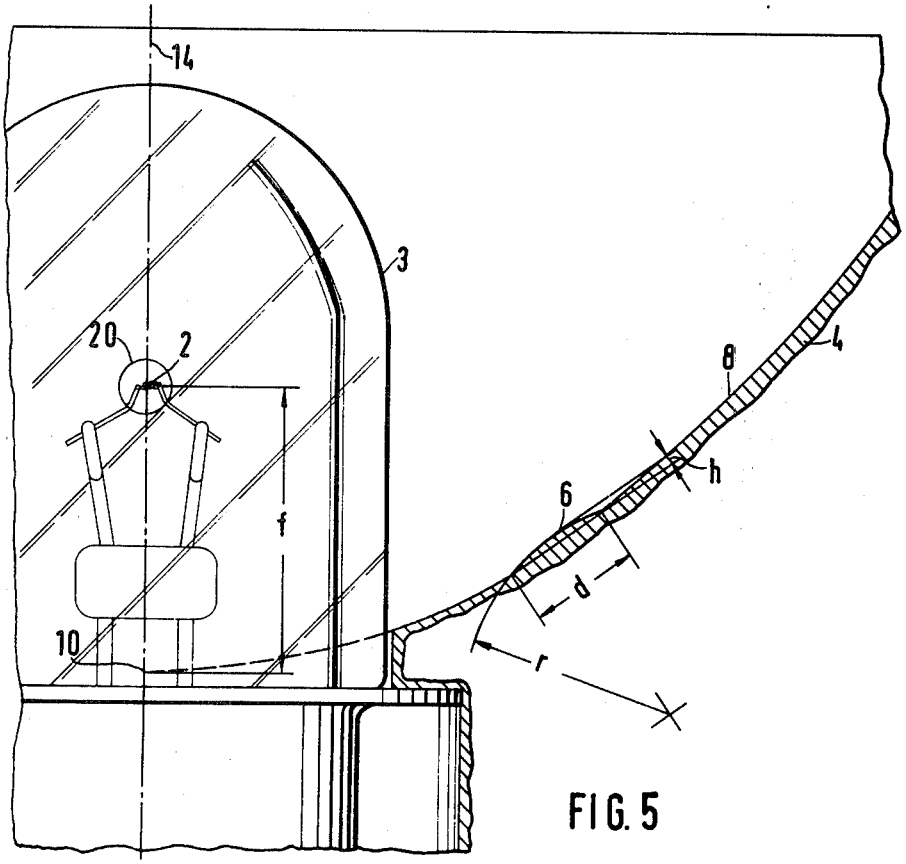
FIG. 5 is an enlarged fragmentary view of FIG. 3 showing a detail thereof rotated through 90°.

In FIG. 3, the lighting fixture according to the invention is shown schematically in a longitudinal sectional view. FIG. 5 shows an enlarged detail of the same lighting fixture shown in FIG. 3.

In the focal space 20 of the peened parabolic concave reflector 4, a luminous body 2 is disposed inside the incandescent lamp 3.

Figure 4:
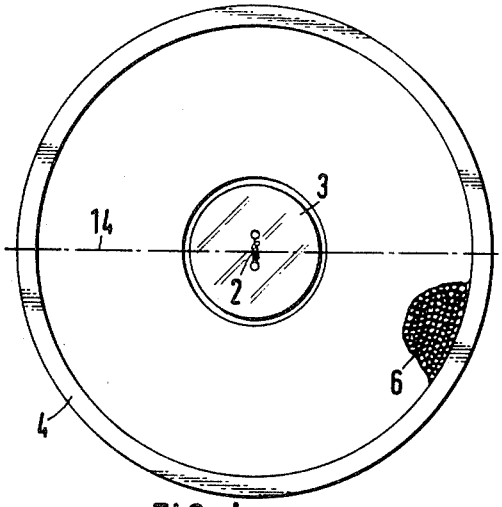
FIG. 4 is an end view of the lighting fixture of FIG. 3 as seen from the right-hand side of the latter figure.

The inner surface 8 of the reflector 4 is formed with reflecting peenings or curved surface portions 6, which are shown only schematically in FIGS. 3 and 4 (on only a fragmentary portion of the reflector surface). FIG. 5, on the other hand, shows, in greatly enlarged view, one reflecting curved surface portion or convexity 6 in the otherwise undisturbed paraboloidal surface 8 of the reflector 4.

Figure 6:
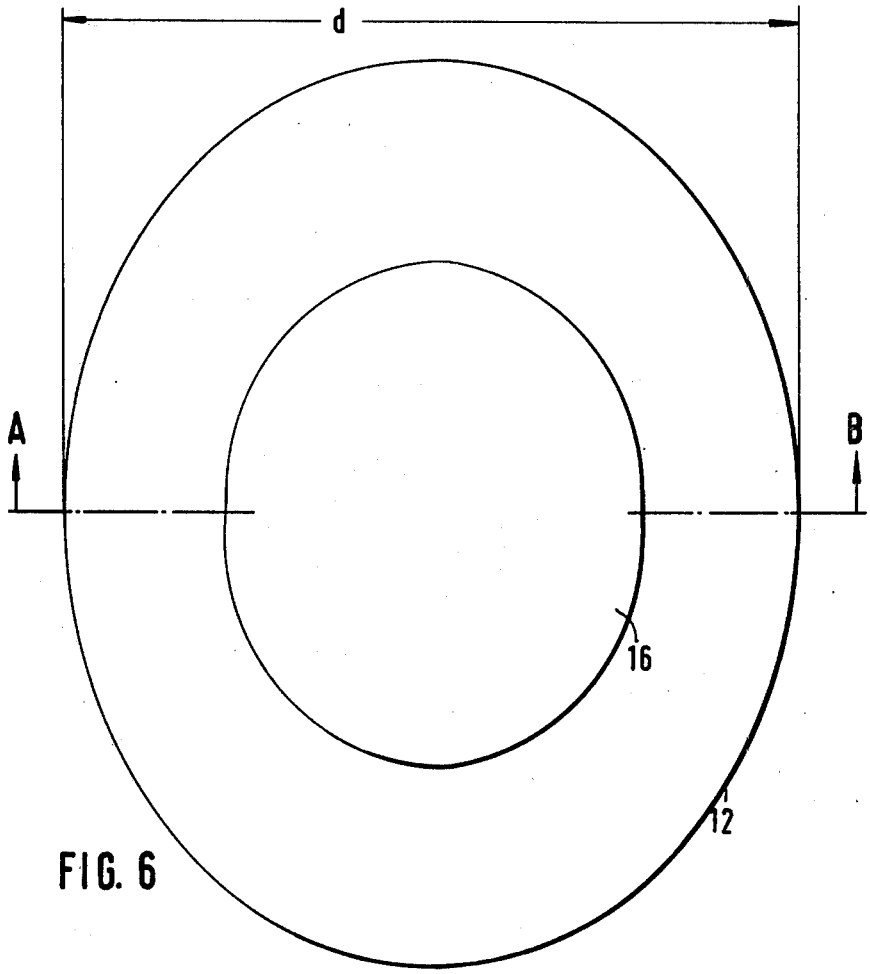
FIG. 6 is a plan view of an elliptical peening or buckling.
Figure 7:
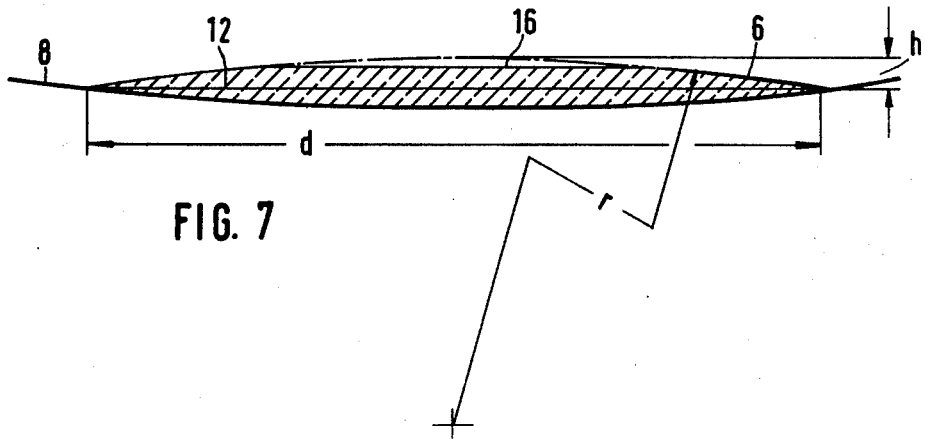
FIG. 7 is a cross-sectional view of FIG. 6 taken along the line A–B in the direction of the arrows.

In FIGS. 6 and 7, one reflecting curved surface portion or convexity 6 is shown, having an area constituting a section of an ellipsoid. The base area of this reflecting convexity 6 is obtained mathematically by the intersection of this ellipsoid with the paraboloidal surface of the parabolic reflector 4. Within the limits of the tolerances that are of interest, this intersection is an ellipse and, as such, is shown in FIG. 6 as a plan view of the reflecting curved surface portion or convexity 6.

The elliptic base area 12 of the reflecting convexity 6 shown in FIGS. 6 and 7 has a minor diameter d. It also has a major diameter which is of no interest with respect to the invention of the instant application. As can be seen in FIG. 5 and particularly in FIG. 7, the reflecting convexity 6, furthermore, has the height h. This is the distance of the highest point of the reflecting convexity 6 from the base surface 12 and is from 3 to 12%, advantageously, 3.5 to 8% and preferably 4 to 6% of the minor base diameter d.

According to FIG. 7, the upper region of the reflecting convexity 6 is cut off, so that this reflecting curved surface portion 6 has a surface region 16 which is parallel to the base area 12 thereof, in order to increase the light intensity in the direction of the reflector axis 14. This planar reflecting surface region 16 is shown in plan view as an ellipse in FIG. 6. The height h indicated for this embodiment of FIGS. 6 and 7 is the original height of the reflecting convexity 6, measured without taking the cut-off part of the convexity 6, that would otherwise have been located on the planar surface area 16, into consideration.

In FIG. 7, the radius of curvature r of the surface of the reflecting convexity 6 is also noted; this radius of curvature r is, strictly speaking, constant over the entire surface of the reflecting convexity 6 only if the latter is constructed as a spherical calotte or cap-shaped member, and hence deviating from the embodiment of FIG. 7.

The reflecting convexities or curved surface portions shown are depicted as prominences or bumps or positive reflecting curvatures, so to speak. Similarly, "negative reflecting curvatures" or concavities could be used instead of or in addition to the bumps or convexities. The depth of such a depression would then be the dimension corresponding to the "height of the reflecting convexity or curvature".

In the embodiment shown in FIGS. 6 and 7, the height h of the reflecting convexity or curvature is equal to 4% of the minor base diameter d of the reflecting convexity or curvature shown; this percentage value lies well within optimal limits of 3% to 12%, according to the invention.

In FIG. 5, there can also be seen the distance f of the apex 10 of the parabolic reflector 4 from the center of the focal space or region 20 thereof. The minimal base diameter of the reflecting curvature 6 is 37% of the distance f and is therefore within a maximal limit of 40% in accordance with the invention.

The radius of curvature r of the reflecting convexity 6 is 75% of the distance f in the embodiment of FIGS. 6 and 7, which is well within the maximal limit of 80% in accordance with the invention.

Figure 8:
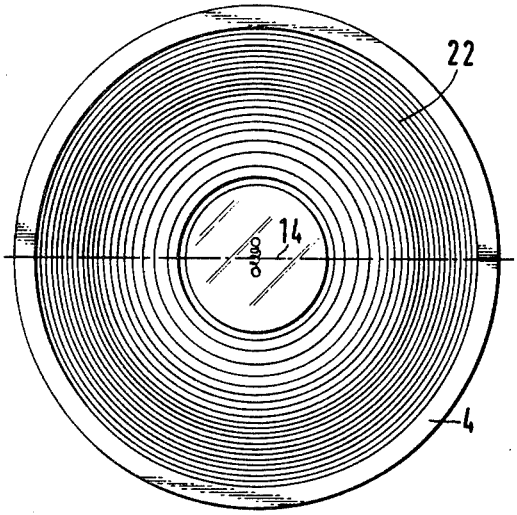
FIG. 8 is a view corresponding to that of FIG. 4, of another embodiment of the lighting fixture provided with annular reflecting, peenings or bucklings.

From a manufacturing point of view, it is simpler in some cases to make the reflecting convexities, in accordance with the embodiment of FIG. 8, as reflecting rings 22 which concentrically or coaxially surround the axis 14 of the concave reflector 4. The reflecting convexity 6 shown in FIG. 5 can be thought of as a radial cross section of such a reflecting ring; it is noted that in such a case, the "base diameter d of the reflecting convexity or curvature" is equal to the width of the reflecting ring, and the height h of the reflecting convexity or curvature is equal to the height of the reflecting ring 22. The reflecting ring is advantageously constructed as a toroidal surface.

According to FIGS. 5 and 7, the reflecting convexities or curvatures project from the otherwise undisturbed paraboloidal surface 8 of the reflector 4. The ratio between the sum of the base areas 12 of the reflecting convexities or curvatures 6 to the remaining, undisturbed paraboloidal surface 8 determines, in substance, the intensity of the light beam in the vicinity of the reflector axis 14; this part of the light beam can be increased additionally by the flat surface regions 16 which are parallel to the base area 12.

A reinforcement or amplification of this part of the light beam can also be attained by the fact that, between the reflecting rings 22, more-or-less wide regions of undisturbed surface remain and/or that the reflecting rings 22 are interrupted by undisturbed surface regions.

Figure 9:
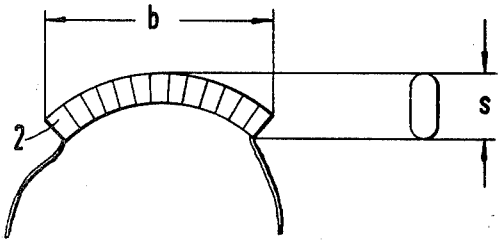
FIGS. 9 and 10 are enlarged fragmentary views of two different embodiments of the luminous body of the lighting fixture, according to the invention.
Figure 10:
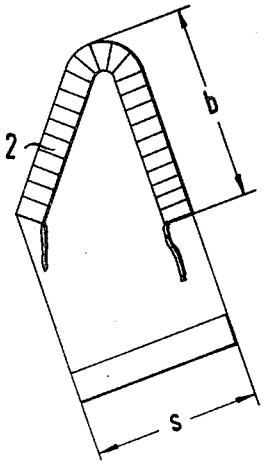

FIGS. 9 and 10 show two embodiments of an individually or singly coiled luminous body 2. The maximal spacing between two points of the luminous region of the luminous body 2 is b. A connecting line between the two points of the luminous i.e. effective, section of the luminous body 2 is designated as the "direction of maximal extension b". This maximal extension b should be at least 200 percent, preferably at least 300 percent and most preferably at least 500 percent of the average heights h of all the reflecting peenings of bucklings or, even better, of each of the heights h of every single reflecting peening or buckling. One may imagine a plane perpendicular to this "direction of maximal extension b", and the luminous body 2 projected on this plane. In simple cases, a figure with an approximately rectangular outline is obtained as the projection and, in the right-hand part of FIG. 9, this outline is folded back into the plane of the drawing. According to the invention, the maximal extension s of this outline is at least 25% of the height h of the reflecting convexity or curvature 6 or of the average value of the height h of all reflecting convexities or curvatures 6.

In addition to lighting fixtures for traffic purposes, it is believed to be readily apparent that the invention can also be used for stationary warning devices such as to mark obstructions and road construction sites.

I claim:

1. Lighting fixture comprising a concave reflector having a given focal region and an axis, and means at least partly disposed in said focal region for supplying a source of light thereat reflectible at maximal intensity by said concave reflector generally in direction of said axis thereof and reflectible at decreasing intensity in directions extending from said light source at an increasing angle $\beta$ relative to the direction of said axis, so that (a) at $\beta = 1°$, the light intensity is at least 200%,
(b) at $\beta = 2.5°$, the light intensity is at least 150%, and
(c) at $\beta = 5°$, the light intensity is at least 120% of the light intensity at $\beta = 10°$, said concave reflector having a reflective surface formed with a multiplicity of reflecting curved surface portions, the mean height of all thereof being equal to from 3% to 12% of the mean smallest base diameter of all of said reflecting curved surface portions.

2. Lighting fixture according to claim 1 wherein said means for supplying a source of light comprises a luminous body having a maximum spacing between two points thereof that is equal to at least 200% of said mean height of all of said reflecting curved surface portions.

3. Lighting fixture according to claim 2 wherein the height of substantially every individual reflecting curved surface portion is equal to from 3% to 12% of the smallest base diameter thereof.

4. Lighting fixture according to claim 2 wherein the maximum dimension of a projection of said luminous body on a plane perpendicular to the direction of the maximum spacing between said two points thereof is equal to at least 25% of said mean height of all of said reflected curved surface portions.

5. Lighting fixture according to claim 2 wherein the maximum dimension of a projection of said luminous body on a plane perpendicular to the direction of the maximum spacing between said two points thereof is equal to at least 25% of the height of substantially every individual reflecting curved surface portion.

6. Lighting fixture according to claim 2 wherein said concave reflector is a parabolic reflector, and wherein said mean smallest base diameter of all of said reflecting curved surface portions is equal at most to 40% of the spacing of the apex of said parabolic reflector from the middle of said focal region of said parabolic reflector.

7. Lighting fixture according to claim 3 wherein said concave reflector is a parabolic reflector, and wherein the smallest base diameter of every individual reflecting curved surface portion is equal at most to 40% of the spacing of the apex of said parabolic reflector from the middle of said focal region of said parabolic reflector.

8. Lighting fixture according to claim 2 wherein said concave reflector is a parabolic reflector, and wherein the surfaces of said reflecting curved surface portions form spherical calottes having a radius of curvature equal at most to 80% of the spacing of the apex of said parabolic reflector from the middle of said focal region of said parabolic reflector.

9. Lighting fixture according to claim 2 wherein said reflecting curved surface portions are formed of at least part of an ellipsoidal surface and said reflecting curved surface portions have an elongated plan view.

10. Lighting fixture according to claim 9 wherein said reflecting curved surface portions are substantially elliptical in said plan view thereof.

11. Lighting fixture according to claim 1 wherein said concave reflector has a reflecting surface formed with a multiplicity of reflecting curved surface portions in the shape of reflecting rings concentrically surrounding said axis of said concave reflector, the mean height of all of said rings being equal to from 3% to 12% of the mean width of all of said rings, said means for supplying a source of light comprising a luminous body having a maximum spacing between two points thereof that is equal to at least 200% of said mean height of all of said rings.

12. Lighting fixture according to claim 11 wherein said rings are formed of sections of reflecting toroidal surfaces.

13. Lighting fixture according to claim 11 wherein said concave reflector is a parabolic reflector, said reflecting rings being formed on the original parabolic surface thereof, and including surface regions parallel to said original parabolic surface and interrupting said reflecting rings for intensifying the light intensity in direction of said axis of said reflector.

14. Lighting fixture according to claim 2 wherein said concave reflector is a parabolic reflector, said reflecting curved surface portions being formed on the original parabolic surface thereof and carrying surface regions thereon that are parallel to said original parabolic surface for intensifying the light intensity in direction of said axis of said reflector.

15. Lighting fixture according to claim 2 wherein said concave reflector has an imaginary concave surface whereon said reflecting curved surface portions are formed, and wherein the sum of the base areas of said reflecting curved surface portions is equal to from 40% to 95% of said imaginary concave surface of said reflector.

16. Lighting fixture according to claim 2 wherein said reflecting surved surface portions are concavities.

17. Lighting fixture according to claim 2 wherein said reflecting curved surface portions are convexities.

18. Lighting fixture according to claim 2 wherein said reflecting curved surface portions are concavities.

19. Lighting fixture comprising a concave reflector having a given focal region and an axis, and means at least party disposed in said focal region for supplying a source of light thereat reflexible at maximal intensity by said concave reflector generally in direction of said axis thereof and reflectible at decreasing intensity in directions extending from said light source at an increasing angle $\beta$ relative to the direction of said axis, so that (a) at $\beta = 1°$, the light intensity is at least 200%,
(b) at $\beta = 2.5°$, the light intensity is at least 150%, and
(c) at $\beta = 5°$, the light intensity is at least 120% of the light intensity at $\beta = 10°$, said means for supplying a source of light comprising a luminous body having a maximum spacing between two points thereof that is equal to at least 200% of said mean height of all of said reflecting curved surface portions.

20. Lighting fixture according to claim 2 wherein the maximum spacing between said two points of said luminous body is at least 200% of the height of substantially every individual reflecting curved surface portion.

21. Lighting fixture comprising a concave reflector having a given focal region and an axis, and means at least partly disposed in said focal region for supplying a source of light thereat reflectible at maximal intensity by said concave reflector generally in direction of said axis thereof, said concave reflector having means for reflecting said light at decreasing intensity in directions extending from said light source at an increasing angle $\beta$ relative to the direction of said axis, said reflecting means being of such construction as to effect the following decreasing light intensity:

(a) at $\beta = 1°$, the light intensity is at least 200%,
(b) at $\beta = 2.5°$, the light intensity is at least 150%, and
(c) at $\beta = 5°$, the light intensity is at least 120% of the light intensity at $\beta = 10°$.

22. Lighting fixture according to claim 19 wherein the height of substantially every individual reflecting curved surface portion is equal to from 3% to 12% of the smallest base diameter thereof.

23. Lighting fixture according to claim 2 wherein said concave reflector is a parabolic reflector, and wherein said mean smallest base diameter of all of said reflecting curved surface portions is equal at most to 40% of the spacing of the apex of said parabolic reflector from the middle of said focal region of said parabolic reflector.

24. Lighting fixture according to claim 2 wherein said concave reflector is a parabolic reflector, and wherein the smallest base diameter of every individual reflecting curved surface portion is equal at most to 40% of the spacing of the apex of said parabolic reflector from the middle of said focal region of said parabolic reflector.

25. Lighting reflector according to claim 2 wherein said concave reflector is a parabolic reflector, and wherein the surfaces of said reflecting curved surface portions form spherical calottes having a radius of curvature equal at most to 80% of the spacing of the apex of said parabolic reflector from the middle of said focal region of said parabolic reflector.

26. Lighting fixture according to claim 2 wherein said reflecting curved surface portions are formed of at least part of an elipsoidal surface and said reflecting curved surface portions have an elongated plan view.

27. Lighting fixture according to claim 2 wherein said concave reflector has a reflecting surface formed with a multiplicity of reflecting curved surface portions in the shape of reflecting rings concentrically surrounding said axis of said concave reflector, the mean height if all of said rings being equal to form 3% to 12% of the mean width of all of said rings, said means for supplying a source of light comprising a luminous body having a maximum spacing between two points thereof that is equal to at least 200% of said mean height of all of said rings.

28. Lighting fixture according to claim 2 wherein said concave reflector is a parabolic reflector, said reflecting curved surface portions being formed on the original parabolic surface thereof and carrying surface regions thereon that are parallel to said original parabolic surface for intensifying the light intensity in direction of said axis of said reflector.

29. Lighting fixture according to claim 2 wherein said concave reflector has an imaginary concave surface whereon said reflecting curved surface portions are formed, and wherein the sum of the base areas of said reflecting curved surface portions is equal to from 40% to 95% of said imaginary concave surface of said reflector.

30. Lighting fixture according to claim 2 wherein said reflecting curved surface portions are convexities.

31. Lighting fixture according to claim 19 wherein the maximum spacing between said two points of said luminous body is at least 200% of the height of substantially every individual reflecting curved surface portion.

* * * * *